US005334318A

United States Patent [19]

Vinci et al.

[11] Patent Number: 5,334,318

[45] Date of Patent: Aug. 2, 1994

[54] COMPOSITIONS CONTAINING ACTIVE SULFUR

[75] Inventors: James N. Vinci, Mayfield Heights; Curtis R. Scharf, Wickliffe, both of Ohio

[73] Assignee: The Lubrizol Corporation, Wickliffe, Ohio

[21] Appl. No.: 87,561

[22] Filed: Jul. 6, 1993

Related U.S. Application Data

[63] Continuation of Ser. No. 381,616, Jul. 18, 1989, abandoned, which is a continuation of Ser. No. 239,586, Sep. 1, 1986, Pat. No. 4,873,006.

[51] Int. Cl.[5] ..... C10M 135/02; C10M 149/00

[52] U.S. Cl. ..... 252/38; 252/33; 252/45; 252/51.5 R; 252/51.5 A

[58] Field of Search ..... 252/51.5 A, 38, 45

[56] References Cited

U.S. PATENT DOCUMENTS

| | | | |
|---|---|---|---|
| 2,384,146 | 9/1945 | Wallace | 252/47.5 |
| 2,392,891 | 1/1946 | Wallace et al. | 252/33 |
| 2,415,296 | 2/1947 | Lincoln et al. | 252/32.7 |
| 2,467,713 | 4/1949 | Watkins | 252/32.7 |
| 3,219,666 | 11/1965 | Norman et al. | 252/51.5 A |
| 3,238,130 | 3/1966 | Matson | 252/32.7 |
| 3,909,426 | 9/1975 | Horokyski | 252/45 |
| 4,119,549 | 10/1978 | Davis | 252/45 |
| 4,119,550 | 10/1978 | Davis et al. | 252/45 |
| 4,170,560 | 10/1979 | Lowe | 252/47.5 |
| 4,474,672 | 10/1984 | Herd et al. | 252/40.7 |
| 4,615,818 | 10/1986 | DiBiase et al. | 252/47.5 |
| 4,690,767 | 9/1987 | DiBiase et al. | 252/47.0 |

*Primary Examiner*—Ellen M. McAvoy

*Attorney, Agent, or Firm*—David M. Shold; Forrest L. Collins

[57] ABSTRACT

Nitrogen containing carboxylic compounds useful in reducing hydrogen sulfide are described herein. The compositions of the invention also desirably contain an alkali or alkaline earth metal containing compound.

22 Claims, No Drawings

COMPOSITIONS CONTAINING ACTIVE SULFUR

This is a continuation of copending application(s) Ser. No. 07/381,616 filed on Jul. 18, 1989, now abandoned, which in turn is a continuation of Ser. No. 07/239,586, filed Sep. 1, 1988, now U.S. Pat. No. 4,873,006.

INTRODUCTION TO THE INVENTION

This invention relates to compositions containing sulfur such as are useful in cutting fluids and with the suppression of hydrogen sulfide evolution from such compositions.

U.S. Pat. No. 4,690,767, issued Sep. 1, 1987, DiBiase and Vinci describes controlling hydrogen sulfide emission from an oil-soluble sulfurized organic compound through the use of a hindered amine with the optional inclusion of a carboxylic acid or acid anhydride. Similar disclosures are made in U.S. Pat. No. 4,615,818, issued Oct. 7, 1986, also to DiBiase and Vinci. Sulfurized compositions prepared by the reaction of unsaturated compounds and a mixture of sulfur and hydrogen sulfide under superatmospheric pressure in the presence of a catalyst are described in U.S. Pat. No. 4,119,549, to Davis issued on Oct. 10, 1978. Such active sulfur containing compositions according to Davis may be utilized in lubricant compositions as well as gear lubricants, metal-working lubricants, and hydraulic fluids. Similar disclosures to the foregoing patent are found in U.S. Pat. No. 4,119,550, to Davis and Holden which issued on Oct. 10, 1978.

U.S. Pat. No. 4,170,560, issued Oct. 9, 1979, to Lowe describes lubricating oil compositions wherein an antioxidant which is a sulfur containing material is used in conjunction with a hydroxy amine compound. Wallace in U.S. Pat. No. 2,384,146, issued Sep. 4, 1945, describes the use of alkanol amines as an odor inhibitor in a sulfurized lubricant. Wallace et al in U.S. Pat. No. 2,392,891, issued Jan. 15, 1946, describe sulfurized oils containing a sodium mahogany soap, a sulfurized oil and triethanolamine which is stated to inhibit odor development.

U.S. Pat. No. 3,238,130 to Matson, issued Mar. 1, 1966, describes the use of oxyalkylated amines as an ingredient in a composition containing an oil-soluble organic sulfur compound. U.S. Pat. No. 3,909,426, describes grease compositions containing dibenzyl disulfide and calcium acetate. Herd et al in U.S. Pat. No. 4,474,672, describe the sulfurization of a base stock in the presence of a magnesium, calcium or barium compound.

U.S. Pat. No. 2,415,296, issued to Lincoln et al on Feb. 4, 1947, describes the use of amine compounds in lubricants containing a sulfur compound. U.S. Pat. No. 2,467,713 to Watkins, issued Apr. 19, 1949, describes lubricating compositions containing a calcium organic compound and an olefin sulfide. The components of Watkins are stated to have improved characteristics especially with respect to oxidation and corrosion.

It is therefore generally known that sulfurized compounds and often active sulfur containing compounds, as later described, may be utilized to add extreme pressure properties to lubricants and cutting fluids. The presence of active sulfur is a problem in that hydrogen sulfide may be generated. Hydrogen sulfide is a toxic gas and even at low levels produces a nauseating odor. It has been generally suggested that amine compounds may be utilized to at least partially control the hydrogen sulfide. Lower molecular weight amine compounds generally present irritation problems and thus a hydrogen sulfide fix employing amines is not desirable. The hydrogen sulfide fix (suppressant) used herein is of low irritant potential and thus highly desirable.

The present invention deals with a unique class of amine compounds which, especially when combined with an alkali or alkaline earth metal salt of an organic compound control hydrogen sulfide emissions in active sulfur containing compounds. The amine compounds of the present invention have been found to be highly selective in effectiveness. In the case of certain non-active sulfur containing compositions the amine compounds increase the generation of hydrogen sulfide. It is also noted that while amines have generally been used to control hydrogen sulfide, the form of the amines themselves sometimes may lead to dermal irritation in particularly sensitive workers. Thus while many amine compounds can control the hydrogen sulfide generation it was unexpected that a particular form of an amine compound would do so and not result in dermal sensitivity.

Throughout the specification and claims, percentages and ratios are by weight, temperatures are in degrees Celsius and pressures are in KPa gauge unless otherwise indicated. It is further noted that numerical ranges given herein are exemplary and may be combined. To the extent that the references cited herein are applicable to the present invention they are incorporated by reference in their entirety.

SUMMARY OF THE INVENTION

The present invention deals with a lubricating composition comprising:

(A) an oil of lubricating viscosity;

(B) the reaction product of at least one polycarboxylic compound having at least one hydrocarbon-based substituent of about 12 to 500 carbon atoms with at least one of: (i) a N-(hydroxyl-substituted hydrocarbyl) amine or (ii) a hydroxyl-substituted poly(hydrocarbyloxy) derivative of said amine;

(C) an active sulfur containing organic compound; and (D) at least one alkali metal or alkaline earth metal containing compound.

The present invention also describes a lubricating composition comprising:

(A) 200 to 1000 parts of an oil of lubricating viscosity;

(B) 0.5 to 20 parts of a nitrogen-containing carboxylic compound made by the reaction of a $C_{12}$ to $C_{500}$ hydrocarbyl substituted succinic acid or anhydride thereof with at least one N-(hydroxyl-substituted hydrocarbyl) amine wherein the amine is mono- or di-hydrocarbyl N-substituted and at least one of the hydrocarbyl substituents is an ethyl group;

(C) 5 parts to 350 parts of an active sulfur containing compound; and (D) 0.5 part to 10 parts of at least one alkali metal or alkaline earth metal containing compound.

A further embodiment of the present invention is a concentrate comprising:

(B) 0.5 to 20 parts of a nitrogen-containing carboxylic compound made by the reaction of a $C_{12}$ to $C_{500}$ hydrocarbyl substituted succinic acid or anhydride thereof with at least one N-(hydroxyl-substituted hydrocarbyl) amine wherein the amine is mono- or di-hydrocarbyl N-substituted and at least one of the hydrocarbyl substituents is an ethyl group;

(C) 5 parts to 350 parts of an active sulfur containing compound; and (D) 0.5 part to 10 parts of at least one alkali metal or alkaline earth metal containing compound.

The present invention also contemplates a method of reducing the presence of free hydrogen sulfide from an active sulfur containing compound including the steps of contacting (C) the active sulfur containing compound with (B) a nitrogen-containing carboxylic compound made by the reaction of at least one polycarboxylic acid acylating agent having at least one hydrocarbon-based substituent of about 12 to 500 carbon atoms with at least one of: (i) a N-(hydroxyl-substituted hydrocarbyl) amine; (ii) a hydroxyl-substituted poly(hydrocarbyloxy) analog of said amine; or (iii) mixtures of (i) and (ii), and heating the mixture of (B) and (C) to reduce the amount of free hydrogen sulfide.

DETAILED DESCRIPTION OF THE INVENTION

The present invention deals with the control of hydrogen sulfide gas. Hydrogen sulfide is highly toxic and presents an obnoxious odor in less than toxic quantities. Numerous sulfur containing compositions have the ability to generate hydrogen sulfide. Lubricating oil compositions, particularly those useful in cutting fluids, contain a high degree of components which are capable of generating hydrogen sulfide. Thus it is highly desirable to present a mechanism for the control of the hydrogen sulfide emission from such products.

The first component to be discussed in the present invention is an oil of lubricating viscosity. The lubricating oils useful herein are the base fluids typically utilized for a variety of purposes including hydraulic fluids, cutting fluids, and the like.

COMPONENT (A)

The oil of lubricating viscosity which is utilized in the preparation of the fluids of the invention may be based on natural oils, synthetic oils, or mixtures thereof.

Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed parafinic-napthenic types. Oils of lubricating viscosity derived from coal or shale are also useful. Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); poly (1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization or ethylene oxide or propylene oxide, the alkyl and aryl ethers of these polyoxyalkylene polymers (e.g.,methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500 etc.) or mono- and polycarboxylic esters thereof, for example, the acetic acid esters, mixed $C_3$-$C_8$ fatty acid esters, or the $C_{13}$oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylexyl alcohol, ethylene glycol, diethylene glycol monoether, propylene glycol, etc.) specific examples of these esters include dibutyl adipate, di(2-ethylhexyl) sebacate, di-n-hexyl fumerate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl) silicate, tetra-(4-methyl-hexyl)-silicate, tetra-(p-tert-butyl-phenyl)silicate, hexyl(4-methyl-2-pentoxy)disiloxane, poly(methyl)siloxanes, poly(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

The fluids of the present invention may also contain water as a partial replacement for the oil of lubricating viscosity. When water is employed with the lubricating oil it is typically present at 5% to 80%, preferably 10% to 70% by weight of the lubricating oil. The amount of water is typically enough to dissolve or disperse the remaining components. Emulsifiers are often used to assist in preparing emulsions of the oil and water fluids.

COMPONENT (B)

The second component to be discussed in the present invention is the reaction product of at least one polycarboxylic compound having at least one hydrocarbon-based substituent of about 12 to about 500 carbon atoms with at least one of: a N-(hydroxyl-substituted hydrocarbyl) amine or (ii) a hydroxyl-substituted poly(hydrocarbyloxy) derivative of said amine. The polycarboxylic compound is also referred to herein as a carboxylic acid acylating agent.

THE CARBOXYLIC COMPOUND

Generally, these carboxylic acid acylating agents are prepared by reacting an olefin polymer or chlorinated analog thereof with an unsaturated carboxylic acid or derivative thereof such as fumaric acid, maleic anhydride the like. Where the acylating agent is monofunctional more than one mole of the acylating agent is used to obtain the polyfunctional group. Often they are polycarboxylic acylating agents such as hydrocarbyl-substituted succinic acids and anhydrides. These acylating agents typically have at least one hydrocarbyl-substituent of about 12 to about 500 carbon atoms. Generally, this substituent has an average of about 20, typically 30, to about 300 or 500 carbon atoms; often it has an average of about 50 to about 250 carbon atoms.

As used herein, the terms "hydrocarbon-based", "hydrocarbon-based substituent" and the like denote a substituent having a carbon atom directly attached to the remainder of the molecule and having predominantly hydrocarbyl character within the context of this invention. Such substituents include the following (1) hydrocarbon substituents, that is, aliphatic (e.g., alkyl or alkenyl), alicyclic (e.g., cycloalkyl, cycloalkenyl) substituents, aromatic-, aliphatic- and alicyclic-substituted aromatic nuclei and the like as well as cyclic substituents wherein the ring is completed through another portion of the molecule (that is, any two indicated substituents may together form an alicyclic radical);

(2) substituted hydrocarbon substituents, that is, those substituents containing non-hydrocarbon radicals which, in the context of this invention, do not alter the predominantly hydrocarbyl substituent; those skilled in the art will be aware of such radicals (e.g., halo (especially chloro and fluoro), alkoxyl, mercapto, alkylmercapto, nitro, nitroso, sulfoxy, etc.;

(3) hetero substituents, that is, substituents which will, while having predominantly hydrocarbyl character within the context of this invention, contain other than carbon present in a ring or chain otherwise composed of carbon atoms. Suitable heteroatoms will be apparent to those of skill in the art and include, for example, sulfur, oxygen, nitrogen and such substituents as e.g., pyridyl, furanyl, thiophenyl, imidazolyl, etc., are exemplary of these hetero substituents.

In general, no more than about three radicals or heteroatoms and preferably no more than one, will be present for each ten carbon atoms in the hydrocarbon-based substituents. Typically, there will be no such radicals or heteroatoms in the hydrocarbon-based substituent and it will, therefore, be purely hydrocarbyl.

In general, the hydrocarbon-based substituents present in the acylating agents used in this invention are free from acetylenic unsaturation; ethylenic unsaturation, when present will generally be such that there is no more than one ethylenic linkage present for every ten carbon-to-carbon bonds in the substituent. The substituents are often completely saturated and therefore contain no ethylenic unsaturation.

As noted above, the hydrocarbon-based substituents present in the acylating agents of this invention may be derived from olefin polymers or chlorinated analogs thereof. The olefin monomers from which the olefin polymers are derived are polymerizable olefins and monomers characterized by having one or more ethylenic unsaturated group. They can be monoolefinic monomers such as ethylene, propylene, butene-1, isobutene and octene-1 or polyolefinic monomers (usually di-olefinic monomers such as butadiene-1,3 and isoprene).

Usually these monomers are terminal olefins, that is, olefins characterized by the presence of the group $-C{=}CH_2$. However, certain internal olefins can also serve as monomers (these are sometimes referred to as medial olefins). When such medial olefin monomers are used, they normally are employed in combination with terminal olefins to produce olefin polymers which are interpolymers. Although the hydrocarbyl-based substituents may also include aromatic groups (especially phenyl groups and lower alkyl and/or lower alkoxy-substituted phenyl groups such as para(tertiary butyl phenyl groups) and alicyclic groups such as would be obtained from polymerizable cyclic olefins or alicyclic-substituted polymerizable cyclic olefins. The olefin polymers are usually free from such groups. Nevertheless, olefin polymers derived from such interpolymers of both 1,3-dienes and styrenes such as butadiene-1,3 and styrene or para(tertiary butyl)styrene are exceptions to this general rule.

Generally the olefin polymers are homo- or interpolymers of terminal hydrocarbyl olefins of about two to about 16 carbon atoms. A more typical class of olefin polymers is selected from that group consisting of homo- and interpolymers of terminal olefins of two to six carbon atoms, especially those of two to four carbon atoms.

Specific examples of terminal and medial olefin monomers which can be used to prepare the olefin polymers from which the hydrocarbon-based substituents are derived include ethylene, propylene, butene-1, butene-2, isobutene, pentene-1, hexene-1, heptene-1, octene-1, nonene-1, decene-1, pentene-2, propylene tetramer, diisobutylene, isobutylene trimer, butadiene-1,2, butadiene-1,3, pentadiene-1,2, pentadiene-1,3, isoprene, hexadiene-1,5, 2-chlorobutadiene-1,3, 2-methylheptene-1, 3-cyclohexylbutene-1, 3,3-dimethylpentene-1, styrenedivinylbenzene, vinylacetate, allyl alcohol, 1-methylvinylacetate, acrylonitrile, ethylacrylate, ethylvinylether and methylvinylketone. Of these, the purely hydrocarbyl monomers are more typical and the terminal olefin monomers are especially typical.

Often the olefin polymers are poly(isobutene)s such as obtained by polymerization of a $C_4$ refinery stream having a butene content of about 35 to about 75 percent by weight and an isobutene content of about 30 to about 60 percent by weight in the presence of a Lewis acid catalyst such as aluminum chloride or boron trifluoride. These polyisobutenes contain predominantly (that is, greater than 80% of the total repeat units) isobutene repeat units of the configuration $$-CH_2C(CH_3)_2-. \quad (I)$$

Typically, the hydrocarbyl-based substituent in the carboxylic acid acylating agent as used in the present invention is a hydrocarbyl, alkyl or alkenyl group of about 12 to about 500 carbon atoms which can be represented by the indicia "hyd". Useful acylating agents include substituted succinic acid agents containing hydrocarbyl-based substituents of about 30–500 carbon atoms.

Often the agents used in making component (B) are substituted succinic acids or derivatives thereof which can be represented by the formula:

$$\text{hyd } CH(COOH)CH_2COOH \quad (II)$$

Such succinic acid acylating agents can be made by the reaction of maleic anhydride, maleic acid, or fumaric acid with the afore-described olefin polymer. Generally, the reaction involves heating the two reactants at a temperature of about 150° C. to about 200° C. Mixtures of polymeric olefins, as well as mixtures of unsaturated mono- and dicarboxylic acids may also be used.

THE N-(HYDROXYL-SUBSTITUTED HYDROCARBYL) AMINE

The hydroxyl hydrocarbyl amines of the present invention generally have one to about four, typically one to about two hydroxyl groups per molecule. These hydroxyl groups are each bonded to a hydrocarbyl group or a hydroxyl-substituted hydrocarbyl group which, in turn, is bonded to the amine portion of the molecule. These N-(hydroxyl-substituted hydrocarbyl) amines can be monoamines or polyamines and they can have a total of up to about 40 carbon atoms; generally they have a total of about 20 carbon atoms. Typically, however, they are monoamines containing but a single hydroxyl group. These amines can be primary, secondary or tertiary amines while the N-(hydroxyl-substituted hydrocarbyl) polyamines can have one or more of any of these types of amino groups. Mixtures of two or more of any of the afore-described amines (A) (II) can also be used to make the carboxylic solubilzer (A).

Examples of N-(hydroxyl-substituted hydrocarbyl) amines for use in this invention are the N-(hydroxy-lower alkyl)amines and polyamines such as 2-hydroxyethylamine, 3-hydroxybutylamine, di-(2-hydroxyethyl)amine, tri-(2-hydroxyethyl)amine, di-(2-hydroxypropyl-)amine, N,N,N'-tri-(2-hydroxyethyl)ethylenediamine, N,N,N',N'-tetra(2-hydroxyethyl)ethylenediamine, N-(2-hydroxyethyl)piperazine, N,N'-di-(3-hydroxypropyl)piperazine, N-(2-hydroxyethyl) morpholine, N-(2-hydroxyethyl)-2-morpholinone, N-(2-hydroxyethyl)-3-methyl-2-morpholinone, N-(2-hydroxypropyl)-6-methyl-2-morpholinone, N-(2-hydroxyethyl)-5-carbethoxy-2-piperidone, N-(2-hydroxypropyl)-5-carbethoxy-2-piperidone, N-(2-hydroxyethyl)-5-(N-butylcarbamyl)-2-piperidone, N-(2-hydroxyethyl)piperidine, N-(4-hydroxybutyl) piperidine, N,N-di-(2-hydroxyethyl)glycine, and ethers thereof with aliphatic alcohols, especially lower alkanols, N,N-di (3-hydroxypropyl) glycine, and the like.

Further amino alcohols are the hydroxy-substituted primary amines described in U.S. Pat. No. 3,576,743 by the general formula $$R_a—NH_2 \quad \text{(III)}$$

where $R_a$ is a monovalent organic radical containing at least one alcoholic hydroxy group; according to this patent, the total number of carbon atoms in $R_a$ will not exceed about 20. Hydroxy-substituted aliphatic primary amines containing a total of up to about 10 carbon atoms are useful. Generally useful are the polyhydroxy-substituted alkanol primary amines wherein there is only one amino group present (i.e., a primary amino group) having one alkyl substituent containing up to 10 carbon atoms and up to 4 hydroxyl groups.

These alkanol primary amines correspond to $R_aNH_2$ wherein $R_a$ is a mono- or polyhydroxy-substituted alkyl group. It is typical that at least one of the hydroxyl groups be a primary alcoholic hydroxyl group. Tris-methylolaminomethane is a typical hydroxy-substituted primary amine. Specific examples of the hydroxy-substituted primary amines include 2-amino-1-butanol, 2-amino-2-methyl-1-propanol, p-(beta-hydroxyethyl)-aniline, 2-amino-1-propanol, 3-amino-1-propanol, 2-amino-2-methyl-1,3-propanediol, 2-amino-2-ethyl-1,3-propanediol, N-(beta-hydroxypropyl)-N'-beta-aminoethyl)piperazine, 2-amino-1-butanol, ethanolamine, beta-(beta-hydroxy ethoxy)-ethyl amine, glucamine, glusoamine, 4-amino-3-hydroxy-3-methyl-1-butene (which can be prepared according to procedures known in the art by reacting isopreneoxide with ammonia), N-3-(aminopropyl)-4(2-hydroxyethyl)-piperadine, 2-amino-6-methyl-6-heptanol, 5-amino-1-pentanol, N-(beta-hydroxyethyl)-1,3-diamino propane, 1,3-diamino-2-hydroxy-propane, N-(beta-hydroxy ethoxyethyl)-ethylenediamine, and the like. For further description of the hydroxy-substituted primary amines useful as the N-(hydroxyl-substituted hydrocarbyl) amines in this invention see U.S. Pat. No. 3,576,743 which is expressly incorporated herein by reference for its disclosure of such amines.

Typically, the amine is a primary, secondary or tertiary alkanol amine or mixture thereof. Such amines can be represented, respectively, by the formulae:

$$H_2N—R'—OH,\ R''NHR'OH \text{ and } (R'')_2NR'OH$$

wherein each R'' is independently a hydrocarbyl group of one to about eight carbon atoms or hydroxyl-substituted hydrocarbyl group of two to about eight carbon atoms and R' is a divalent hydrocarbyl group of about two to about eighteen carbon atoms. The group —R'—OH in such formulae represents the hydroxyl-substitued hydrocarbyl group. R'' can be an acyclic, alicyclic or aromatic group. Typically, it is an acyclic straight or branched alkylene group such as an ethylene, 1,2-propylene, 1,2-butylene, 1,2-octadecylene, etc. group. Where two R'' groups are present in the same molecule they can be joined by a direct carbon-to-carbon bond or through a heteroatom (e.g., oxygen, nitrogen or sulfur) to form a 5-, 6-, 7- or 8-membered ring structure. Examples of such hetrocyclic amines include N-(hydroxyl lower alkyl)-morpholines, -thiomorpholines, -piperidines, -oxazolidines, -thiazolidines and the like. Typically, however, each R'' is a lower alkyl group of up to 7 carbon atoms.

The amine can also be an ether N-(hydroxyl-substituted hydrocarbyl)amine. These are hydroxyl-substituted poly(hydrocarbyloxy) analogs of the above-described amines (these analogs also include hydroxyl-substituted oxyalkylene analogs). Such amines can be conveniently prepared by reaction of epoxides with afore-described amines and can be represented by the formulae:

$$H_2N—(R'O)_xH$$

$$R''NH(R'O)_xH$$

$$(R'')_2N(R'O)_xH$$

wherein x is a number from 2 to about 15 and R' and R'' are as described above.

Polyamine analogs of these alkanol amines, particularly alkoxylated alkylene polyamines (e.g., N,N-(diethanol)-ethylene diamine) can also be used to make the solubilizers of this invention. such polyamines can be made by reacting alkylene amines (e.g., ethylene diamine) with one or more alkylene oxides (e.g., ethylene oxide, octadecene oxide) of 2 to about 20 carbons. Similar alkylene oxide-alkanol amine reaction products can also be used such as the products made by reacting the afore-described primary, secondary or tertiary alkanol amines with ethylene, propylene or higher epoxides in a 1:1 to 1:2 molar ratio. Reactant ratios and temperatures for carrying out such reactions are known to those skilled in the art.

Examples of alkoxylated alkylene polyamines include N-(2-hydroxyethyl)ethylene diamine, N,N-bis(2-hydroxyethyl)-ethylene diamine, 1-(2-hydroxyethyl)-piperazine, mono(hydroxypropyl)-sbustituted diethylene triamine, di(hydroxypropyl)-substituted tetraethylene pentamine, N-(3-hydroxybutyl)-tetramethylene diamine, etc. Higher homologs obtained by condensation of the above-illustrated hydroxy alkylene polyamines through amino radicals or through hydroxy radicals are likewise useful. Condensation through amino radicals results in a higher amine accompanied by removal of ammonia while condensation through the hydroxy radicals results in products containing ether linkages accompanied by removal of water. Mixtures of two or more of any of the afore-described mono- or polyamines are also useful.

Particularly useful examples of N-(hydroxyl-substituted hydrocarbyl)amines include mono-, di-, and triethanol amine, diethylethanol amine, di-(3-hydroxyl propyl) amine, N-(3-hydroxyl butyl) amine, N-(4-hydroxyl butyl) amine, N,N-di-(2-hydroxyl propyl) amine, N-(2-hydroxyl ethyl) morpholine and its thio analog, N-(2-hydroxyl ethyl) cyclohexyl amine, N-3-hydroxyl cyclopentyl amine, o-, m- and p-aminophenol, N-(hydroxyl ethyl) piperazine, N,N'-di(hydroxyl ethyl) piperazine, and the like. Preferred amines are diethyl ethanol amine and ethanol amine and mixtures thereof.

Reacting the Acylating Agent and Amine

The reaction of the acylating agent with the hydroxyl amine can be carried out at temperatures ranging from about 30° C. and up to but not including the decomposition temperature of the reaction components and/or products having the lowest such decomposition temperature. Generally the reaction is carried out at a temperature in the range of about 50° C. to about 150° C.; but usually at a temperature below about 100° C. Often the reaction is carried out under ester-forming conditions and the product thus formed is, for example, an ester, salt, amide, imide, amic ester or mixture of such products. The salt may be an internal salt, wherein one of the carboxyl groups becomes ionically bound to a nitrogen atom within the same group of it may be an external salt wherein the ionic salt group is formed with a nitrogen atom which is not part of the same group forming the ester group. Mixtures of acylating agents and/or mixtures of hydroxyl amines can be used.

Generally, the ratio of acylating agent to N-(hydroxyl-substituted hydrocarbyl)amine is in the range of 0.5 to about 3 moles of amine per equivalent of acylating agent. An equivalent of acylating agent can be determined by dividing its molecular weight by the number of carboxyl functions present. These can usually be determined from the structural formula of the acylating agent or empirically through well-known titration procedures. For example, a succinic acid anhydride or di-alkyl ester acylating agent has an equivalent weight of one-half its molecular weight. The amine equivalent weight is determined by the number of hydrogen atoms with each amine hydrogen giving one equivalent.

The reaction of acylating agent and hydroxyl amine can be carried out in the presence of a normally liquid, substantially inert, organic solvent/diluent such as benzene, octane, and commercial mixtures such as the various textile spirits and naphthas. Mineral oils in small amounts can also be used. Such solvent/diluents aid in temperature control, viscosity control and the like. Often, however, when the reactants are sufficiently fluid such solvent/diluents are not used and the reaction is carried out in the absence of any materials other than the acylating agent and the hydroxyl amine. Terminal olefin monomers are especially typical.

Examples of the preparation of Component (B) are as shown below.

EXAMPLE B-I

To 6,720 parts of a poly(isobutene)-substituted succinic anhydride (molecular weight 1120 Mn) is slowly added over 1.5 hours 702 parts of diethyl ethanol amine with mixing. To accomplish the mixing the temperature of the reaction is maintained at 90° C. with stirring. This intermediate mixture is heated for an additional 0.5 hours at 90° C. and then 366 parts of mono-ethanol amine is added. The mixture is held at 90° C. for a final 0.5 hour and is cooled to provide component (B-I).

EXAMPLE B-II

To a charge of 224 parts of a poly(isobutene)-substituted succinic anhydride (molecular weight 1120 Mn) are slowly added 468 parts of diethyl ethanol amine over 2 hours with stirring at 90° C. The heating is continued for an additional hour at 90° C. This component (B-II) is a viscous, brownish liquid at room temperature.

COMPONENT C

Component (C) is the active sulfur containing compound. A definition of active sulfur is that the compound meets the definition of sulfur reactive with copper powder at a temperature of 149° C. The test method for determining active sulfur is determined in the *STANDARD TEST METHOD FOR ACTIVE SULFUR IN CUTTING FLUIDS* Designation: D 1662–69 (Reapproved 1979) as set forth by the American Society for Testing and Materials (ASTM). A further description of sulfur compounds useful herein is as disclosed below. Preferably, the active sulfur compounds are dispersible in oil and/or in water.

The active sulfur compositions of the present invention comprise at least one sulfurized organic compound. A wide variety of sulfurized organic compounds can be utilized and these compounds may generally be represented by the formula $$RS_xR_1 \qquad \text{(IV)}$$

wherein S represents sulfur, x is a whole number having a value of from 1 to about 10, and R and $R_1$ may be the same or different organic groups. The organic groups may be hydrocarbon groups or substituted hydrocarbon groups containing alkyl, aryl, aralkyl, alkaryl, alkanoate, thiazole, imidazole, phosphorothionate, beta-ketoalkyl groups, etc. The substantially hydrocarbon groups may contain other substituents such as halogen, amino, hydroxyl, mercapto, alkoxy, aryloxy, thio, nitro, sulfonic acid, carboxylic acid, carboxylic acid ester, etc.

Specific examples of types of sulfurized compositions include aromatic, alkyl or alkenyl sulfides and polysulfides, sulfurized olefins, sulfurized carboxylic acid esters, sulfurized ester olefins, sulfurized oil, and mixtures thereof. The preparation of such oil-soluble sulfurized compositions is described in the art.

The sulfurized organic compounds utilized in the present invention can be aromatic and alkyl sulfides such as dibenzyl sulfide, dixylyl sulfide, dicetyl sulfide, diparaffin wax sulfide and polysulfide, cracked wax oleum sulfides, etc. One method of preparing the aromatic and alkyl sulfides includes the condensation of a chlorinated hydrocarbon with an inorganic sulfide whereby the chlorine atom from each of two molecules is displaced, and the free valence from each molecule is joined to a divalent sulfur atom. Generally, the reaction is conducted in the presence of elemental sulfur.

Examples of dialkenyl sulfides are described in U.S. Pat. No. 2,446,072. These sulfides can be prepared by reacting an olefinic hydrocarbon containing from 3 to 12 carbon atoms with elemental sulfur in the presence of zinc or a similar metal generally in the form of an acid salt. Examples of sulfides of this type include 6,6'-dithiobis(5-methyl-4-nonene), 2-butenyl monosulfide and disulfide (the diisobutyl sulfides), and 2-methyl-2-butenyl monosulfide and disulfide.

The sulfurized olefins include materials prepared by the reaction of an olefin (preferably containing 2 to 6 carbon atoms) or a lower molecular weight polyolefin derived therefrom, with a sulfur-containing compound such as sulfur, sulfur monochloride, sulfur dichloride, hydrogen sulfide and combinations thereof.

The olefinic compound (IV) is usually one in which each R value (R or $R_1$) is independently alkyl, alkenyl or aryl, or (less often) a corresponding substituted group. Monoolefinic and diolefinic compounds, particularly the former, are preferred, and especially terminal monoolefinic hydrocarbons. Olefinic compounds having about 3 to 30, desirably about 3 to 16, especially 9 or less, and preferably 8 carbon atoms are particularly desirable.

Ethylene, isobutene, propylene and oligomers thereof are especially preferred olefinic compounds. Of these compounds, isobutylene and diisobutylene are particularly desirable because of their availability and the particularly high sulfur-containing compositions which can be prepared therefrom.

Another class of organic sulfur-containing compounds include sulfurized aliphatic esters of an olefinic mono- or dicarboxylic acid. For example, aliphatic alcohols of from 1 to 30 carbon atoms can be used to esterify monocarboxylic acids such as acrylic acid, methacrylic acid, 2,4-pentadienoic acid, etc. or fumaric acid, maleic acid, muconic acid, etc. Sulfurization of these esters is conducted with elemental sulfur, sulfur monochloride and/or sulfur dichloride.

Still another class of sulfurized organic compounds which can be utilized in the compositions of the invention are diestersulfides characterized by the following general formula $$-S_y[(CH_2)_xCOOR]_2 \quad (V)$$

wherein x is from about 2 to about 5; y is from 1 to about 6, preferably 1 to about 3; and R is an alkyl group having from about 4 to about 20 carbon atoms. The R group may be a straight chain or branched chain group that is large enough to maintain the solubility of the compositions of the invention in oil. Typical diesters include the butyl, amyl, hexyl, heptyl, octyl, nonyl, decyl, tridecyl, myristyl, pentadecyl, cetyl, heptadecyl, stearyl, lauryl, and eicosyl diesters of thiodialkanoic acids such as propionic, butanoic, pentanoic and hexanoic acids. Of the diester sulfides, a specific example is dilauryl, 3,3'-thiodipropionate.

It is desired that sulfurized triglyceride fatty acid esters should not utilized in the present invention. The sulfurized triglycerides have been found to generate hydrogen sulfide gas upon the addition of the amine component of the present invention. Thus the sulfurized triglycerides in any more than minute amounts are not desired in the present invention. By minute amounts is it meant that amounts greater than 20% by weight of the oil-soluble active sulfur organic compound should not be employed. The sulfurized triglycerides of fatty acids are typically those materials obtained by reacting sulfur, sulfur monochloride, and/or sulfur dichloride with an unsaturated fatty ester at an elevated temperature. Such materials are typically obtained from animal fats and vegetable oils such as tall oil, linseed oil, olive oil, castor oil, peanut oil, rapeseed oil, fish oil, sperm oil, and the like.

An active sulfur composition is prepared as described below.

EXAMPLE C-I

A sulfurized olefin is prepared by reacting sulfur, hydrogen sulfide and diisobutylene. Thus, 128 grams of sulfur (4 moles) is charged to a jacketed high pressure reactor which is fitted with an agitator and internal cooling coil. Refrigerated brine is circulated through the coils to cool the reactor prior to the introduction of the gaseous reactants. After sealing the reactor, evacuating to a pressure of less than 0.5 KPa and cooling, 224 grams (2 moles) of diisobutylene and 34 grams (1 mole) of hydrogen sulfide are charged to the reactor.

The reactor is then heated using steam in the external jacket to a temperature of about 171° C. over about 1.5 hours. A maximum pressure of 8600 KPa is reached at about 168° C. during the heat-up step. Prior to reaching the reaction temperature, the pressure starts to decrease and continues to decrease steadily as the gaseous reactants are consumed.

After about 10 hours at a reaction temperature of about 171° C., the pressure is approximately 2100–2200 KPa and the rate of pressure drop is about 30–70 KPa per hour.

At this time the reaction is essentially complete and the unreacted hydrogen sulfide and diisobutylene are vented to a recovery system. After the presssure of the reactor has decreased to ambient, the sulfurized mixture is recovered as a liquid. The mixture is then blown with nitrogen and vacuum stripped to remove the low boiling materials including unreacted diisobutylene, mercaptans and monosulfides.

The residue is the desired sulfurized composition which contains approximately 40% sulfur by weight.

COMPONENT (D)

Component (D) is at least one alkali metal or alkaline earth metal containing compound. This component may be either overbased, or a neutral alkali or alkaline earth metal salt. The preferred salts are neutral calcium or magnesium salts, in particular neutral calcium alkylbenzene sulfonate salts wherein the alkyl group contains from 12 to 30 carbon atoms. A further description of the alkali metal or alkaline earth metal compounds useful in the present invention is as follows.

The metal-containing composition (D) may be an alkali metal or alkaline earth metal salt of sulfur acids, carboxylic acids, phenols and phosphorus acids. These salts can be neutral or basic. The former contain an amount of metal cation just sufficient to neutralize the acidic groups present in salt anion; the latter contain an excess of metal cation and are often termed overbased, hyperbased or superbased salts.

These basic and neutral salts can be of oil-soluble organic sulfur acids such as sulfonic, sulfamic, thiosulfonic, sulfinic, sulfenic, partial ester sulfuric, sulfurous and thiosulfuric acid. Generally they are salts of aliphatic or aromatic sulfonic acids. The basic salts have a metal ratio greater than one. The metal ratio is the total equivalents of metal present to the substrate equivalents.

The sulfonic acids include the mono- or poly-nuclear aromatic or cycloaliphatic compounds. The sulfonic acids can be represented for the most part by the following formulae:

$$R^1(SO_2H)_r \quad \text{(VI)}$$

$$(R^2)_xT(SO_3H)_y \quad \text{(VII)}$$

in which T is an aromatic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, cyclohexane, petroleum naphthenes, decahydronaphthalene, cyclopentane, etc; $R^1$ and $R^2$ are each independently aliphatic groups, $R^1$ contains at least about 15 carbon atoms, the sum of the carbon atoms in $R^2$ and T is at least about 15, and r, x and y are each independently 1 or greater.

Specific examples of $R^1$ are groups derived from petrolatum, saturated and unsaturated paraffin wax, and polyolefins, including polymerized $C_2$, $C_3$, $C_4$, $C_5$, $C_6$, etc., olefins containing from about 15 to 7000 or more carbon atoms. The groups T, $R^1$ and $R^2$ in the above formulae can also contain other inorganic or organic substituents in addition to those enumerated above such as, for example, hydroxy, mercapto, halogen, nitro, amino, nitroso, sulfide, disulfide, etc. The subscript x is generally 1–3, and the sum of the subscripts x+y generally have an average value of about 1–4 per molecule.

The following are examples of oil soluble sulfonic acids coming within the scope of Formulae I and II above, and it is to be understood that such examples serve also to illustrate certain salts of such sulfonic acids useful in this invention. In other words, for every sulfonic acid enumerated it is intended that the corresponding neutral and basic metal salts thereof are also understood to be illustrated. Such sulfonic acids are mahogany sulfonic acids; bright stock sulfonic acids; sulfonic acids derived from lubricating oil fractions having a Saybolt viscosity from about 100 seconds at 100° F. (37.7° C.) to about 200 seconds at 210° F. (99° C.); petrolatum sulfonic acids; mono- and poly-wax substituted sulfonic and polysulfonic acids of, e.g., benzene, diphenylamine, thiophene, alpha-chloronaphthalene, etc.; other substituted sulfonic acids such as alkyl benzene sulfonic acids (where the alkyl group has at least 8 carbons), cetylphenol mono-sulfide sulfonic acids, dicetyl thianthrene disulfonic acids, dilauryl beta naphthyl sulfonic acids, and alkaryl sulfonic acids such as dodecyl benzene "bottoms" sulfonic acids.

The latter are acids derived from benzene which has been alkylated with propylene tetramers or isobutene trimers to introduce 1, 2, 3 or more branched-chain $C_{12}$ substituents on the benzene ring. Dodecyl benzene bottoms, principally mixtures of mono- and di-dodecyl benzenes, are available as by-products from the manufacturer of household detergents. Similar products obtained from alkylation bottoms formed during manufacture of linear alkyl sulfonates (LAS) are also useful in making the sulfonates used in this invention.

The production of sulfonates from detergent manufacture by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Other descriptions of neutral and basic sulfonate salts and techniques for making them can be found in the following U.S. Pat. Nos.: 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,097; 2,315,514; 2,319,121; 2,321,022; 2,333,568; 2,333,788; 2,335,259; 2,337,552; 2,347,568; 2,366,027; 2,374,193; 2,383,319; 3,312,618; 3,471,403; 3,488,284; 3,595,790 and 3,798,012. These are hereby incorporated by reference for their disclosures in this regard. Also included are aliphatic sulfonic acids such as paraffin wax sulfonic acids, unsaturated paraffin wax sulfonic acids, hydroxy-substituted paraffin wax sulfonic acids, hexapropylene sulfonic acids, tetra-amylene sulfonic acids, polyisobutene sulfoinc acids wherein the polyisobutene contains from 20 to 7000 or more carbon atoms, chlorosubstituted paraffin wax sulfonic acids, nitro-paraffin wax sulfonic acids, etc; cyclo-aliphatic sulfonic acids such as petroleum naphthene sulfonic acids, cetyl cyclopentyl sulfonic acids, lauryl cyclohexyl sulfonic acids, bis-(di-isobutyl) cyclohexyl sulfonic acids, mono- or poly-wax substituted cyclohexyl sulfonic acids, etc.

The carboxylic acids from which suitable neutral and basic alkali metal and alkaline earth metal salts for use in this invention can be made include aliphatic, cycloaliphatic, and aromatic mono and polybasic carboxylic acids such as the naphthenic acids, alkyl- or alkenyl-substituted cyclopentanoic acids, the corresponding cyclohexanoic acids and the corresponding aromatic acids. The aliphatic acids generally contain at least eight carbon atoms and preferably at least twelve carbon atoms. Usually they have no more than about 400 carbon atoms. Generally, if the aliphatic carbon chain is branched, the acids are more oil soluble for any given carbon atom content. The cycloaliphatic and aliphatic carboxylic acids can be saturated or unsaturated. Specific examples include 2-ethylhexanoic acid, alpha-linolenic acid, propylenetetramer-substituted maleic acid, behenic acid, isostearic acid, pelargonic acid, capric acid, palmitoleic acid, linoleic acid, lauric acid, oleic acid, ricinoleic acid, undecylic acid, dioctylcyclo-pentane carboxylic acid, myristic acid, dilauryldecahydronaphthalene carboxylic acid, stearyl-octahydroindene carboxylic acid, palmitic acid, commercially available mixtures of two or more carboxylic acids such as tall oils acids, rosin acids, and the like.

A preferred group of oil-soluble carboxylic acids useful in preparing the salts used in the present invention are the oil-soluble aromatic carboxylic acids. These acids are represented by the general formula:

$$(R^*)_aAr^*(CXXH)_m \quad \text{(VIII)}$$

where R* is an aliphatic hydrocarbon-based group of at least four carbon atoms, and no more than about 400 aliphatic carbon atoms, a is an integer of from one to four, Ar* is a polyvalent aromatic hydrocarbon nucleus of up to about 14 carbon atoms, each X is independently a sulfur or oxygen atom, and m is an integer of from one to four with the proviso that R* and a are such that there is an average of at least 8 aliphatic carbon atoms provided by the R* groups for each acid molecule represented by Formula III. Examples of aromatic nuclei represented by the variable Ar* are the polyvalent aromatic radicals derived from benzene, naphthalene, anthracene, phenanthrene, indene, fluorene, biphenyl, and the like. Generally, the radical represented by Ar* will be a polyvalent nucleus derived from benzene or naphthalene such as phenylenes and naphthlene, e.g., methylphenylenes, ethoxyphenylenes, nitropheynlenes, isopropylphenylenes, hydroxyphenylenes, mercaptophenylenes, N,N-diethylaminophenylenes, chlorophenylenes, dipropoxynaphthylenes, triethylnaphthylenes, and similar tri-, tetra-, pentavalent nuclei thereof, etc.

The R* groups are usually purely hydrocarbyl groups, preferably groups such as alkyl or alkenyl radicals. However, the R* groups can contain small number substituents such as phenyl, cycloalkyl (e.g., cyclohexyl, cyclopentyl, etc.) and nonhydrocarbon groups such as nitro, amino, halo (e.g., chloro, bromo, etc.) lower alkoxy, lower alkyl mercapto, oxo substituents (i.e.,=O), thio groups (i.e.,=S) interrupting groups such as —NH—, —O—, —S—, and the like provided the essentially hydrocarbon character of the R* group is retained. The hydrocarbon character is retained for purposes of this invention so long as any non-carbon atoms present in the R* group do not account for more than about 10% of the total weight of the R* groups.

Examples of R* groups include butyl, isobutyl, pentyl, octyl, nonyl, dodecyl, docosyl, tetracontyl, 5-chlorohexyl, 4-ethoxypentyl, 2-hexenyl, cyclohexyloctyl, 4-(p-chlorophenyl)-octyl, 2,3,5-trimethylheptyl, 2-ethyl-5-methyloctyl, and substituents derived from polymerized olefins such as polychloroprenes, polyethylenes, polypropylenes, polyisobutylenes, ethylenepropylene copolymers, chlorinated olefin polymers, oxidized ethylenepropylene copolymers, and the like. Likewise, the group Ar may contain non-hydrocarbon substituents, for example, such diverse substituents as lower alkoxy, lower alkyl mercapto, nitro, halo, alkyl or alkenyl groups of less than four carbon atoms, hydroxy, mercapto and the like.

A group of particularly useful carboxylic acids are those of the formula:

$$R^*_a Ar^*(CXXH)_m(XH)_p \quad \text{(IX)}$$

where R*, X, Ar*, m and a are as defined in Formula III and p is an integer of 1 to 4, usually 1 or 2. Within this group, an especially preferred class of oil-soluble carboxylic acids are those of the formula:

$$(R^{**})Ph_a(COOH)_b(OH)_c \quad \text{(X)}$$

where R in Formula V is an aliphatic hydrocarbon group containing at least 4 to about 400 carbon atoms, Ph is a phenyl group, a is an integer of from 1 to 3, b is 1 or 2, c is zero, 1, or 2 and preferably 1 with the proviso that R and a are such that the acid molecules contain at least an average of about twelve aliphatic carbon atoms in the aliphatic hydrocarbon substituents per acid molecule. And within this latter group of oil-soluble carboxylic acids, the aliphatic-hydrocarbon substituted salicylic acids wherein each aliphatic hydrocarbon substituent contains an average of at least about sixteen carbon atoms per substituent and one to three substituents per molecule are particularly useful. Salts prepared from such salicylic acids wherein the aliphatic hydrocarbon substituents are derived from polymerized olefins, particularly polymerized lower 1-mono-olefins such as polyethylene, polypropylene, polyisobutylene, ethylene/propylene co-polymers and the like and having average carbon contents of about 30 to 400 carbon atoms.

The carboxylic acids corresponding to formula (VIII) and IX above are well known or can be prepared according to procedures known in the art. Carboxylic acids of the type illustrated by the above formulae and processes for preparing their neutral and basic metal salts are well known and disclosed, for example, as in such U.S. Pat. Nos. 2,197,832; 2,197,835; 2,252,662; 2,252,664; 2,714,092; 3,410,798 and 3,595,791.

Another type of neutral and basic carboxylate salt used in this invention are those derived from hydrocarbyl succinates of the general formula:

$$R^*CH(COOH)CH_2COOH \quad \text{(XI)}$$

wherein R* is as defined above in formula VIII. Such salts and means for making them are set forth in U.S. Pat. Nos. 3,271,130; 3,567,637 and 3,632,610.

Other patents specifically describing techniques for making basic salts of the hereinabove-described sulfonic acids, carboxylic acids, and mixtures of any two or more of these include U.S. Pat. Nos. 2,501,731; 2,616,904; 2,616,905; 2,616,906; 2,616,911; 2,616,924; 2,616,925; 2,617,049; 2,777,874; 3,027,325; 3,256,186; 3,282,835; 3,384,585; 3,373,108; 3,368,396; 3,342,733; 3,320,162; 3,312,618; 3,318,809; 3,471,403; 3,488,284; 3,595,790 and 3,629,109.

Neutral and basic salts of phenols (generally known as phenates) are also useful in the compositions of this invention and well known to those skilled in the art. The phenols from which these phenates are formed are of the general formula:

$$(R^*)_a—(Ar^*)—(OH)_m \quad \text{(XII)}$$

wherein R*, a, Ar*, and m have the same meaning and preferences as described hereinabove with reference to Formula III. The same examples described with respect to Formula III also apply.

The commonly available class of phenates are those made from phenols of the general formula:

$$(R')_a R^4)_z Ph(OH)_b \quad \text{(XIII)}$$

wherein a is an integer of 1–3, b is 1 or 2, z is 0 or 1, Ph is a phenyl group, R' in Formula VIII is a substantially saturated hydrocarbon-based substituent having an average of from about 30 to about 400 aliphatic carbon atoms and $R^4$ is selected from the group consisting of lower alkyl, lower alkoxyl, nitro, and halo groups.

One particular class of phenates for use in this invention are the basic (i.e., overbased, etc.) alkali and alkaline earth metal sulfurized phenates. Techniques for making these sulfurized phenates are described in U.S. Pat. Nos. 2,680,096; 3,036,971 and 3,775,321.

Other phenates that are useful are those that are made from phenols that have been linked through alkylene (e.g., methylene) bridges. Such linked phenates as well as sulfurized phenates are described in detail in U.S. Pat. No. 3,350,038; particularly columns 6–8 thereof.

Alkali and alkaline earth metal salts of phosphorus acids also are useful in the fuel compositions of the invention. For example, the normal and basic salts of the phosphonic (phosphonates) and/or thiophosphonic acids prepared by reacting inorganic phosphorus reagents such as $P_2S_5$ with petroleum fractions such as bright stock or polyolefins obtained from olefins of 2 to 6 carbon atoms. Particular examples of the polyolefins are polybutenes having a molecular weight of from 700 to 100,000. Other phosphorus-containing reagents which have been reacted with olefins include phosphorus trichloride or phosphorus trichloride-sulfur chloride mixtures, (e.g., U.S. Pat. Nos. 3,001,981 and 2,195,517), phosphites and phosphite chlorides (e.g., U.S. Pat. Nos. 3,033,890 and 2,863,834), and air or oxygen with a phosphorus halide (e.g., U.S. Pat. No. 2,939,841).

Other patents describing phosphorus acids and metal salts useful in the present invention and which are prepared by reacting olefins with phosphrous sulfides include the following U.S. Pat. Nos.: 2,316,078; 2,316,079; 2,316,080; 2,316,081; 2,316,082; 2,316,085; 2,316,088; 2,375,315; 2,406,575; 2,496,508; 2,766,206; 2,838,484; 2,893,959 and 2,907,713. These acids which are described in the above patents as being oil additives, are useful in the fuel composition of the present invention. The acids can be converted to neutral and basic salts by reactions which are well known in the art.

Mixtures of two or more neutral and basic salts of the hereinabove described organic sulfur acids, carboxylic acids, phosphorus acids and phenols can be used in the compositions of this invention. Usually the neutral and basic salts will be magnesium, or calcium salts.

The following specific illustrative examples describe the preparation of exemplary alkali and alkaline earth metal compositions (D) useful in the compositions of this invention.

EXAMPLE D-I

A mixture of 1000 parts of a primary branched sodium monoalkyl benzene sulfonate (M.W. of the acid is 522) in 637 parts of mineral oil is neutralized with 145.7 parts of a 50% caustic soda solution and the excess water and caustic removed. The product containing the sodium salt obtained in this manner contains 2.5% sodium and 3.7% sulfur.

EXAMPLE D-II

The procedure of Example D-I is repeated except that the caustic soda is replaced by a chemically equivalent amount of $Ca(OH)_2$.

EXAMPLE D-III

The procedure of Example D-I is repeated except that the caustic soda is replaced by a chemically equivalent amount of magnesium oxide.

EXAMPLE D-IV

A mixture of 906 parts of an alkyl phenyl sulfonic acid (having an average molecular weight of 450, by vapor phase osmometry), 564 parts mineral oil, 600 parts toluene, 98.7 parts magnesium oxide and 120 parts water is blown with carbon dioxide at a temperature of 78°–85° C. for seven hours at a rate of about 3 cubic feet of carbon dioxide per hour (85 l/hr). The reaction mixture is constantly agitated throughout the carbonation. After carbonation, the reaction mixture is stripped to 165° C./20 torr (2.65 KPa) and the residue filtered. The filtrate is an oil solution of the desired overbased magnesium sulfonate having a metal ratio of about 3.

EXAMPLE D-V

A mixture of 323 parts of mineral oil, 4.8 parts of water, 0.74 parts of calcium chloride, 79 parts of lime, and 128 parts of methyl alcohol is prepared, and warmed to a temperature of about 50° C. To this mixture there is added with mixing, 1000 parts of an alkyl phenyl sulfonic acid having an average molecular weight (vapor phase osmometry) of 500. The mixture then is blown with carbon dioxide at a temperature of about 50° C. at the rate of about 5.4 lbs. per hour (40.8g/minute) for about 2.5 hours. After carbonation, 102 additional parts of oil are added and the mixture is stripped of volatile materials at a temperature of about 150°–155° C. at 55 mm (7.3 KPa) pressure. The residue is filtered and the filtrate is the desired oil solution of the overbased calcium sulfonate having calcium content of about 3.7% and a metal ratio of about 1.7.

EXAMPLE D-VI

The neutral calcium salt of a $C_{12}$ polypropylene succinic acid is prepared by reacting one equivalent of calcium with one equivalent of the succinic acid.

RATIOS AND AMOUNTS OF COMPONENTS

The composition of the present invention conveniently contains any effective amount of the varied components as recited in the Summary of the Invention. Typically the oil of lubricating viscosity will be present as a major amount (at least one half of the weight) of the components of the composition and the remaining components will be present as a minor amount. In particular, it is desirable that the weight ratio of component (B) to component (C) be about 5:1 to about 1:200, more preferably about 3:1 to 1:150. The weight ratio of component (C) to component (D) is typically from about 200:1 to about 1:3, preferably about 150:1 to about 1:1. The use of component (B) is typically in a weight ratio to component (D) of about 10:1 to about 1:10, preferably about 7:1 to about 1:7.

An overall formulated lubricating composition within the present invention typically will contain from 200 to 1000 parts of an oil of lubricating viscosity; component (B) at 0.5 to 20 parts; component (C) at 5 parts to 350 parts, preferably 10 parts to 300 parts; and component (D) at 0.5 parts to 10 parts, preferably 1 part to 7 parts. The desired composition is obtained by mixing the components in any order. Preferably (B) and (C) are combined and heated. Alternatively (B), (C) and (D) are combined and heated. It is preferable that heating be employed to facilitate removal of free or labile hydrogen sulfide during and after mixing the composition. Typically, the composition will be heated at 25° C. to 100° C., usually from 35° C. to 90° C.

The following are suggested embodiments of the present invention.

EXAMPLE I

A composition is prepared comprising 98 parts of an active sulfur-containing sulfurized olefin according to C-I and 2 parts of the composition of Example B-II. This composition is mixed together and stored for 1 week at 65° C. after which vapor phase hydrogen sulfide generation is measured.

At the end of one week it is determined that the head space in the container has 160 ppm of hydrogen sulfide gas. A comparative sample containing only the sulfurized olefin contains 1400 ppm of hydrogen sulfide in the head space.

This example demonstrates substantial reduction in the generation of hydrogen sulfide through the use of the nitrogen-containing carboxylic compound of the present invention.

EXAMPLE II

A sulfurized active sulfur-containing composition in the amount of 97 parts per Example C-I is combined with 2 parts of the nitrogen-containing carboxylic compound of Example B-II, and 1 part of the calcium sulfonate neutral salt of Example D-II. A sample of the above formulation is placed in a capped bottle and heated at 65° C. for a period of one week. No hydrogen sulfide generation is observed after one week. A comparable sample containing only the active sulfur-containing compound exhibits 1400 ppm of hydrogen sulfide after one week under similar conditions. An additional benefit to the present example is the presence of the calcium sulfonate material which provides greater clarity of the composition.

EXAMPLE III

A composition is prepared as in Example II with the exception that a magnesium sulfonate is utilized in place of the calcium sulfonate. No hydrogen sulfide is found in a head space after one week of storage of the product at 65° C.

EXAMPLE IV

A product is formulated according to Example II and in this case a magnesium salicylate per Example D-IV is substituted for the calcium salt. The magnesium salicylate has an alkyl chain of 12 carbon atoms.

A sample of the product stored according to the preceding Example shows only a trace of hydrogen sulfide generation at 65° C.

EXAMPLE V

A composition formulated as an Example II containing a neutral sodium polypropylene substituted succinic acid having 12 carbon atoms in the polypropylene chain per Example D-VII. A sample of the foregoing product is stored in a capped bottle at 65° C. for one week. At the end of one week there is no detectable hydrogen sulfide in the sample.

EXAMPLE VI

A product is formulated according to Example V using 25 parts of the composition described therein, 500 parts of mineral oil and 20 parts of tallow. The foregoing composition is tested as a cutting fluid and is found to perform its intended purpose.

Other additives which may optionally be present in the metal working lubricants for use in this invention include:

Antioxidants, typically hindered phenols.

Surfactants, usually non-ionic surfactants such as oxyalkylated phenols and the like.

Corrosion, wear and rust inhibiting agents.

Friction modifying agents, of which the following are illustrative: alkyl or alkenyl phosphates or phosphites in which the alkyl or alkenyl group contains from about 10 to about 40 carbon atoms, and metal salts thereof, especially zinc salts; $C_{10-20}$ fatty acid amides; $C_{10-20}$ alkyl amines, especially tallow amines and ethoxylated derivatives thereof; salts of such amines with acids such as boric acid or phosphoric acid which have been partially esterified as noted above; $C_{10-20}$ alkyl-substituted imidazolines and similar nitrogen heterocycles.

Any metal to be worked may be treated according to the method of this invention. Examples are ferrous metals, aluminum, copper, magnesium, titanium, zinc and manganese. Alloys thereof, with and without other elements such as silicon, may also be treated: examples of suitable alloys are brass and various steels (e.g., stainless steel).

The compositions used in the method of this invention can be applied to the metal workpiece prior to or during the working operation in any suitable manner. They may be applied to the entire surface of the metal, or to any portion of that surface with which contact is desired. For example, the lubricant can be brushed or sprayed on the metal, or the metal can be immersed in a bath of the lubricant. In high speed metal forming operations spraying or immersion are preferred.

In a typical embodiment of the method of this invention, a ferrous metal workpiece is coated with the lubricant prior to the working operation. For example, if the workpiece is to be cut it may be coated with the lubricant before contact with the cutting tool. (The invention is particularly useful in connection with cutting operations.) It is also within the scope of the invention to apply the lubricant to the workpiece as it contacts the cutting tool, or to apply it to the cutting tool itself whereupon it is transferred to the workpiece by contact. Thus, the method of this invention in a generic sense comprises any metal working operation wherein the workpiece has on its surface, during said operation, the above-described lubricant regardless of how applied.

What is claimed is:

1. A lubricating composition comprising:

(A) an oil of lubricating viscosity;

(B) the reaction product of at least one polycarboxylic compound having at least one hydrocarbon-based substituent of 50 to 500 carbon atoms derived from an olefin polymer or chlorinated analog thereof, wherein the polymer is derived from at least one hydrocarbyl olefin having 2 to 16 carbon atoms, with at least one of: (i) a N-(hydroxyl-substituted hydrocarbyl) amine or (ii) a hydroxyl-substituted poly(hydrocarbyloxy) derivative of said amine;

(C) an active sulfur containing organic compound; and (D) at least one alkali metal or alkaline earth metal containing compound.

2. The composition of claim 1 wherein component (D) is an alkaline earth metal containing compound.

3. The composition of claim 1 wherein the polycarboxylic compound is a hydrocarbyl-substituted succinic acid, anhydride, or derivative thereof.

4. The composition of claim 1 wherein the active sulfur containing compound is of the formula $$RS_xR_1 \qquad \text{(IV)}$$

wherein S represents sulfur, x is a whole number having a value of about 3 to about 10, and R and $R_1$ are the same or different organic groups.

5. The composition of claim 2 wherein the alkaline earth metal containing compound is a calcium compound.

6. The composition of claim 1 wherein the weight ratio of (B) to (C) is about 5:1 to 1:200.

7. The composition of claim 1 wherein the weight ratio of (C) to (D) is about 200:1 to 1:3.

8. The composition of claim 3 wherein the reaction product (B) is obtained from a material which is (a) an alkanol amine represented by the formula $$H_2NR'OH;\ R''NHR'OH;\ \text{or}\ (R'')_2NR'OH$$

or a hydrocarbyl-substituted oxyalkylene derivative of the alkanol amine represented by the formula $$H_2N(R'O)_xH;\ R''NH(R'O)_xH;\ \text{or}\ (R'')_2N(R'O)_xH$$

wherein each R'' is independently a hydrocarbyl group of 1 to about 8 carbon atoms, or a hydroxyl-substituted hydrocarbyl group of about 2 to about 8 carbon atoms and R' is a divalent hydrocarbyl group of about 2 to about 18 carbon atoms, x is an integer of about 2 to about 15; or mixtures of any of the foregoing compounds.

9. The composition of claim 2 wherein the alkaline earth metal containing compound is a magnesium compound.

10. The composition of claim 1 wherein the active sulfur containing compound is a sulfurized olefin.

11. The composition of claim 1 wherein the alkali metal or alkaline earth metal containing compound is an overbased material.

12. The composition of claim 1 wherein the alkali metal or alkaline earth metal containing compound contains an organic substrate which is at least one of a hydrocarbyl-substituted phenate, salicylate, sulfonate, phosphonate or succinate.

13. The composition of claim 1 and a sufficient amount of water to dissolve or disperse the composition in water.

14. The composition of claim 1 wherein the weight ratio of (B) to (D) is about 10:1 to 1:10.

15. The composition of claim 10 wherein the active sulfur compound is a diisobutyl sulfide.

16. The composition of claim 1 wherein component (D) is a substantially neutral salt.

17. A workpiece having thereon the composition of claim 1.

18. The lubricating composition of claim 1 comprising 200 to 1000 parts of the oil (A), 0.5 to 20 parts of the reaction product (B), 5 to 350 parts of the active sulfur containing organic compound (C), and 0.5 to 10 parts of the at least one alkali metal or alkaline earth metal containing compound (D).

19. The lubricating composition of claim 1 wherein (B) is the reaction product of a polycarboxylic compound with an alkanolamine represented by the formula $$H_2NR'OH;\ R''NHR'OH;\ \text{or}\ (R'')_2NR'OH$$

or a hydrocarbyl-substituted oxyalkylene derivative of the alkanolamine represented by the formula $$H_2N(R'O)_xH;\ R''NH(R'O)_xH;\ \text{or}\ (R'')_xN(R'O)_xH$$

wherein each R'' is independently a hydrocarbyl group of 1 to about 8 carbon atoms, or a hydroxyl-substituted hydrocarbyl group of about 2 to about 8 carbon atoms and R' is a divalent hydrocarbyl group of about 2 to about 18 carbon atoms, x is an integer of about 2 to about 15; or mixtures of any of the foregoing compounds;

(C) is a sulfurized olefin; and (D) is a calcium or magnesium sulfonate.

20. A concentrate comprising:

(B) 0.5 to 20 parts of a reaction product of a succinic acid, having at least one hydrocarbon-based substituent of 50 to 500 carbon atoms derived from an olefin polymer or chlorinated analog thereof, wherein the polymer is derived from at least one olefin having 2 to 16 carbon atoms, or the anhydride thereof, with at least one N-(hydroxyl-substituted hydrocarbyl) amine, wherein the amine is mono- or di-hydrocarbyl N-substituted and at least one of the hydrocarbyl substituents is an ethyl group;

(C) 5 to 350 parts of an active sulfur containing compound; and (D) 0.5 to 10 parts of at least one alkali metal or alkaline earth metal containing compound.

21. A lubricating composition comprising:

(A) an oil of lubricating viscosity;

(B) the reaction product of:

at least one succinic acid, anhydride, or derivative thereof having at least one hydrocarbon-based substituent of 50 to 500 carbon atoms derived from an olefin polymer or chlorinated analog thereof, wherein the polymer is derived from at least one hydrocarbyl olefin having 2 to 16 carbon atoms; with diethyl ethanol amine or a hydrocarbyl-substituted oxyalkylene derivative of diethyl ethanol amine represented by the formula $$(C_2H_5)_2NC_2H_4O(R'O)_xH;$$

wherein R' is a divalent hydrocarbyl group of about 2 to about 18 carbon atoms and x is an integer of about 1 to about 14; or mixtures of the foregoing compounds;

(C) an active sulfur containing organic compound; and (D) at least one alkali metal or alkaline earth metal containing compound.

22. A lubricating composition comprising:

(A) an oil of lubricating viscosity;

(B) the reaction product of (i) an alkyl-substituted succinic anhydride and (ii) an ethanolamine represented by the formula $$H_2NC_2H_4OH;\ R''NHC_2H_4OH;\ \text{or}\ (R'')_2C_2H_4OH;$$

wherein each R'' is independently a hydrocarbyl group of 1 to about 8 carbon atoms, or a hydroxyl-substituted hydrocarbyl group of about 2 to about 8 carbon atoms; or mixtures of any of the foregoing compounds, said reaction product being present in an amount of 0.5 to 20 parts by weight;

(C) an active sulfur containing organic compound, present in an amount of 5 to 350 part by weight; and (D) at least one calcium sulfonate, present in an amount of 0.5 to 10 parts by weight.

* * * * *